US012704118B2

(12) United States Patent
Ghosh et al.

(10) Patent No.: US 12,704,118 B2
(45) Date of Patent: Aug. 11, 2026

(54) INLINE PISTON PUMP

(71) Applicant: Eaton Intelligent Power Limited, Dublin (IE)

(72) Inventors: Arindam Ghosh, Pune (IN); Stephen Marshall Devan, Madison, MS (US); Kelly Dale Valtr, Aurora, TX (US); Charles Andrew Shand, Southampton (GB); Sauradeep Datta, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 279 days.

(21) Appl. No.: 17/374,358

(22) Filed: Jul. 13, 2021

(65) Prior Publication Data

US 2022/0018340 A1 Jan. 20, 2022

(30) Foreign Application Priority Data

Jul. 15, 2020 (IN) ..... 202011030087

(51) Int. Cl.
*F04B 1/2085* (2020.01)

(52) U.S. Cl.
CPC ..... *F04B 1/2085* (2013.01)

(58) Field of Classification Search
CPC ..... F04B 1/2085; F04B 1/126; F04B 1/2078; F04B 1/124; F01B 3/0088; F01B 3/0085; F01B 3/0073; F01B 3/007; F03C 1/0671; F03C 1/0668
See application file for complete search history.

(56) References Cited

U.S. PATENT DOCUMENTS 2,069,651 A * 2/1937 Ferris ..... F01B 3/105 91/504
2,300,009 A * 10/1942 Rose ..... F01B 3/0085 91/488
2,936,633 A * 5/1960 Cameron-Johnson ..... F01B 3/0085 74/60
2,967,491 A * 1/1961 Wiggermann ..... F04B 1/2042 91/505
3,291,068 A * 12/1966 Wiggermann ..... F01B 3/0038 91/488
4,738,185 A * 4/1988 Kamimura ..... F01B 13/04 91/503
4,741,251 A 5/1988 Hayashi et al.
4,945,817 A * 8/1990 Scholl ..... F04B 1/2085 91/505

(Continued)

FOREIGN PATENT DOCUMENTS

CN 2649802 Y 10/2004
DE 3700575 A1 * 7/1988 ..... F04B 1/2078

(Continued)

OTHER PUBLICATIONS

DE 3700575 A1 machine translation to English from espacenet (Year: 1988).*

(Continued)

*Primary Examiner* — Michael Quandt
(74) *Attorney, Agent, or Firm* — Merchant & Gould P.C.

(57) ABSTRACT

An inline piston pump that is efficient, manufacturable, and durable. The angled bearing surface within the pump that it contacts drives the piston and rotates with the cylinder.

19 Claims, 17 Drawing Sheets

(56) References Cited

U.S. PATENT DOCUMENTS

| | | | | |
|---|---|---|---|---|
| 5,022,310 | A * | 6/1991 | Stewart | F01B 3/005 91/501 |
| 5,176,066 | A * | 1/1993 | Kanamaru | F04B 1/2092 91/499 |
| 5,554,009 | A * | 9/1996 | Ohta | F04B 1/146 417/269 |
| 5,704,272 | A * | 1/1998 | Durako, Jr. | F04B 1/2078 91/499 |
| 6,036,374 | A * | 3/2000 | Fisher | F04B 1/2085 91/499 |
| 6,287,086 | B1 * | 9/2001 | Steen | F04B 1/2085 91/499 |
| 6,601,992 | B2 | 8/2003 | Tabuti et al. | |
| 6,886,523 | B2 | 5/2005 | Steffes et al. | |
| 7,845,738 | B2 | 12/2010 | Borgemenke et al. | |
| 7,941,998 | B2 | 5/2011 | Nakano et al. | |
| 9,624,914 | B2 | 4/2017 | Maruoka et al. | |
| 2004/0165996 | A1 | 8/2004 | Lanfredi | |

FOREIGN PATENT DOCUMENTS

| | | | |
|---|---|---|---|
| GB | 2508374 | A | 6/2014 |
| JP | 2000154775 | A | 6/2000 |
| JP | 2021-42725 | A | 3/2021 |
| WO | 2006122642 | A1 | 11/2006 |

OTHER PUBLICATIONS

Great Britain Search Report for Application No. GB2110162.1 mailed Dec. 17, 2021.

Examination Report issued in corresponding GB Patent Application No. 2110162.1, Mar. 18, 2024.

Search Report in corresponding GB Patent Application No. 2110162.1, Dec. 17, 2021.

* cited by examiner

INLINE PISTON PUMP

CROSS-REFERENCE TO RELATED APPLICATION

This application claims the benefit of Indian Provisional Patent Application No. 202011030087, filed on Jul. 15, 2020, the disclosure of which is incorporated herein by reference in its entirety.

TECHNICAL FIELD

The present disclosure provides an inline piston pump.

BACKGROUND

Inline piston pumps are used for pumping hydraulic fluids. Piston pumps are used in a wide range of industries and applications. For example, they are used in the aerospace industry to deploy and retract the landing gear of an airplane. Inline piston pumps work by including multiple pistons in a cylinder that suck in fluid from a low-pressure inlet and deliver it to a high-pressure outlet. As the cylinder rotates, the pistons are driven against an angled plate that causes the pistons to reciprocate. Typically, the angled plate does not rotate with the cylinder. The ends of the pistons include shoes that contact and slide along the non-rotating angled plate. The interface between the angled plate and the piston is prone to wear. The shoes are typically constructed of a bronze end portion on a ball joint and include a hydrostatic pad to reduce wear. The hydrostatic pads act as a leakage path for the fluid reducing the volumetric efficiency of the pump.

Some efforts have been made to redesign traditional inline piston pumps to avoid reliance on expensive and difficult to manufacture shoes which introduce mechanical and hydraulic inefficiencies. For example, see U.S. Pat. Nos. 6,036,374; 4,741,251; 7,941,998; 9,624,914; WO2006122642; CN2649802; and JP3781908, which are all herein incorporated by reference in their entireties. Known inline piston pump configurations that do not have traditional piston shoes have their own challenges and drawbacks. Therefore, there continues to be a need for advancement in the inline piston pump's design. Pumps with higher efficiency, longer life, and less cost and complexity in its manufacture are desired.

SUMMARY

The present disclosure provides an inline piston pump that is efficient, manufacturable, and durable. In the depicted embodiment, the angled yoke assembly within the pump that contacts and drives the piston synchronously rotates with the cylinder.

BRIEF DESCRIPTION OF THE FIGURES

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION

Figure 1:
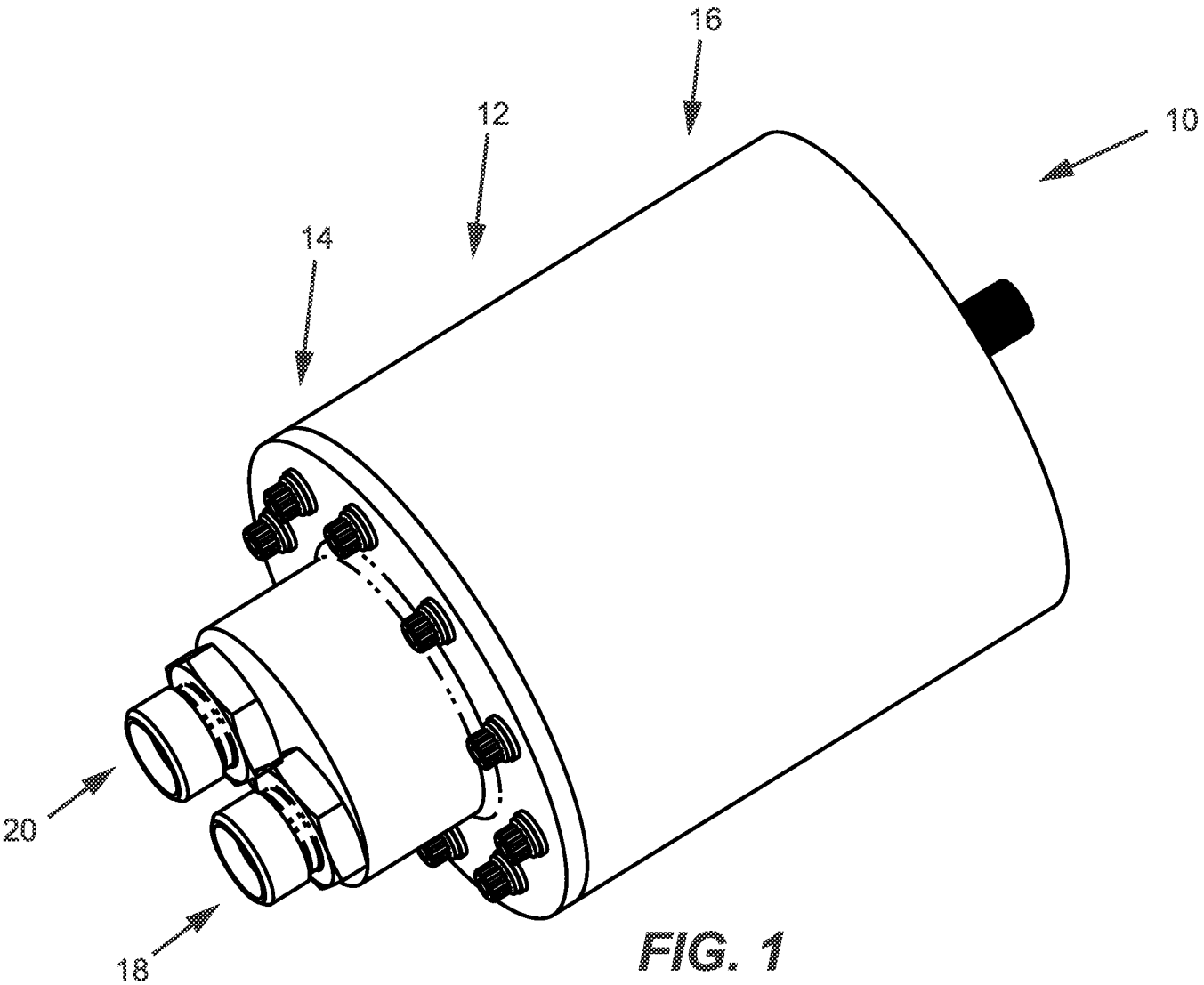
FIG. 1 is an isometric view of an embodiment of the pump according to the principles of the present disclosure.
Figure 2:
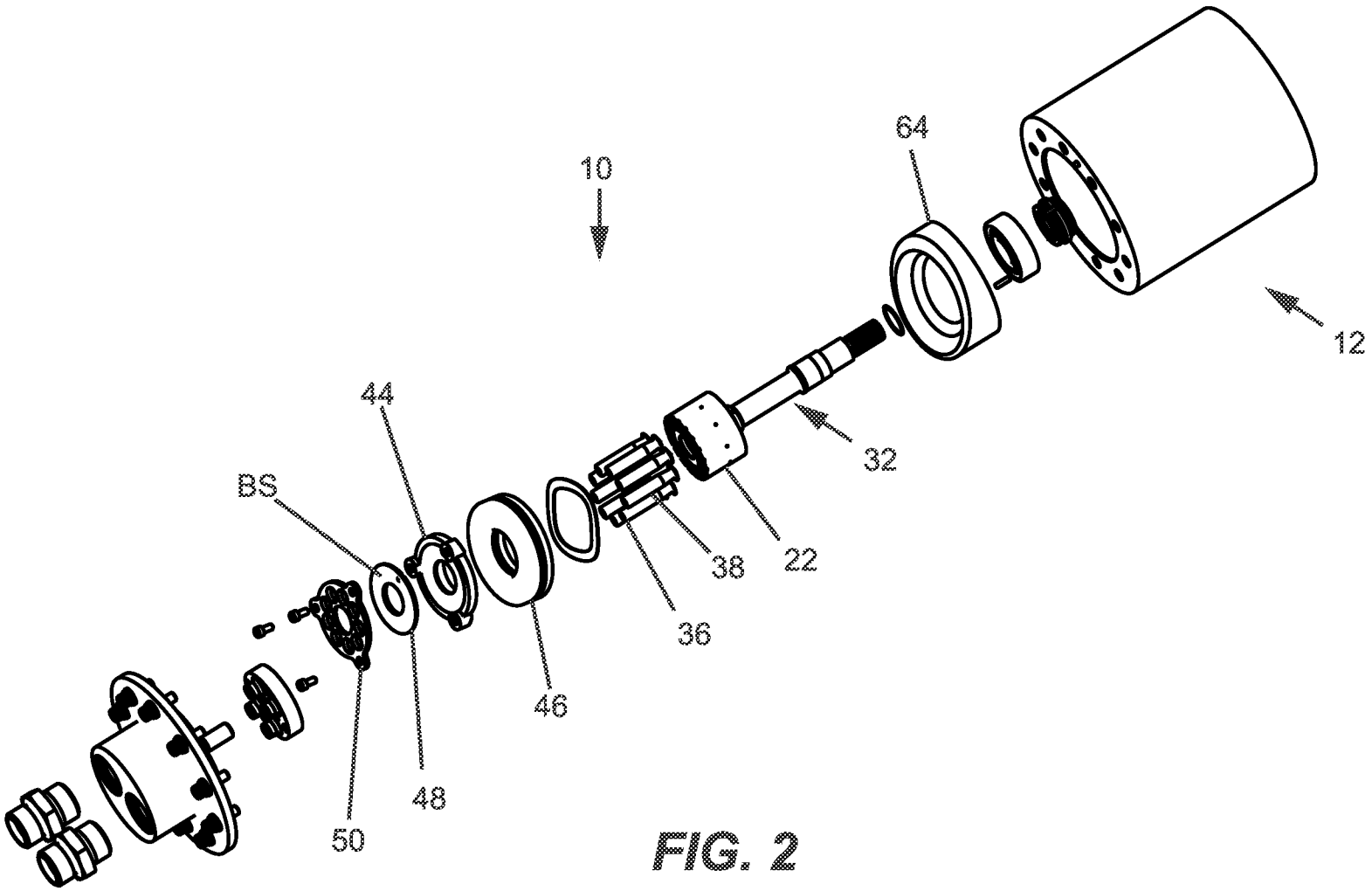
FIG. 2 is an exploded assembly view of the pump of FIG. 1.

Reference will now be made in detail to embodiments of the present disclosure, examples of which are described herein and illustrated in the accompanying drawings. While the invention will be described in conjunction with embodiments, it will be understood that they are not intended to limit the invention to these embodiments. On the contrary, the invention is intended to cover alternatives, modifications, and equivalents, which may be included within the spirit and scope of the invention as defined by the appended claims.

Referring to the figures, the pump of the present disclosure is described in further detail. In the depicted embodiment, the pump 10 includes a housing 12. In the depicted embodiment, the housing 12 includes a first end portion 14 and a second end portion 16. The first end portion 14 includes a low-pressure fluid inlet 18 and a high-pressure fluid outlet 20. It should be appreciated that many alternative housing configurations are possible. It should also be appreciated that the same technology described and shown herein can be used for a hydraulic motor.

The pump 10 of the depicted embodiment includes a cylinder block 22 rotatably positioned within the housing 12. In the depicted embodiment, the cylinder block 22 includes a first end portion 24 and a second end portion 26. The first end portion 24 of the cylinder block 22 is positioned in the first end portion 14 of the housing 12. The second end portion 26 of the cylinder block 22 is positioned in the second end portion 16 of the housing 12. In the depicted embodiment, the cylinder block 22 includes a plurality of cylindrical bores 28, 30 that extend from the first end portion 24 to the second end portion 26 of the cylinder block 22. It should be appreciated that many alternative cylinder block configurations are possible.

Figure 9:
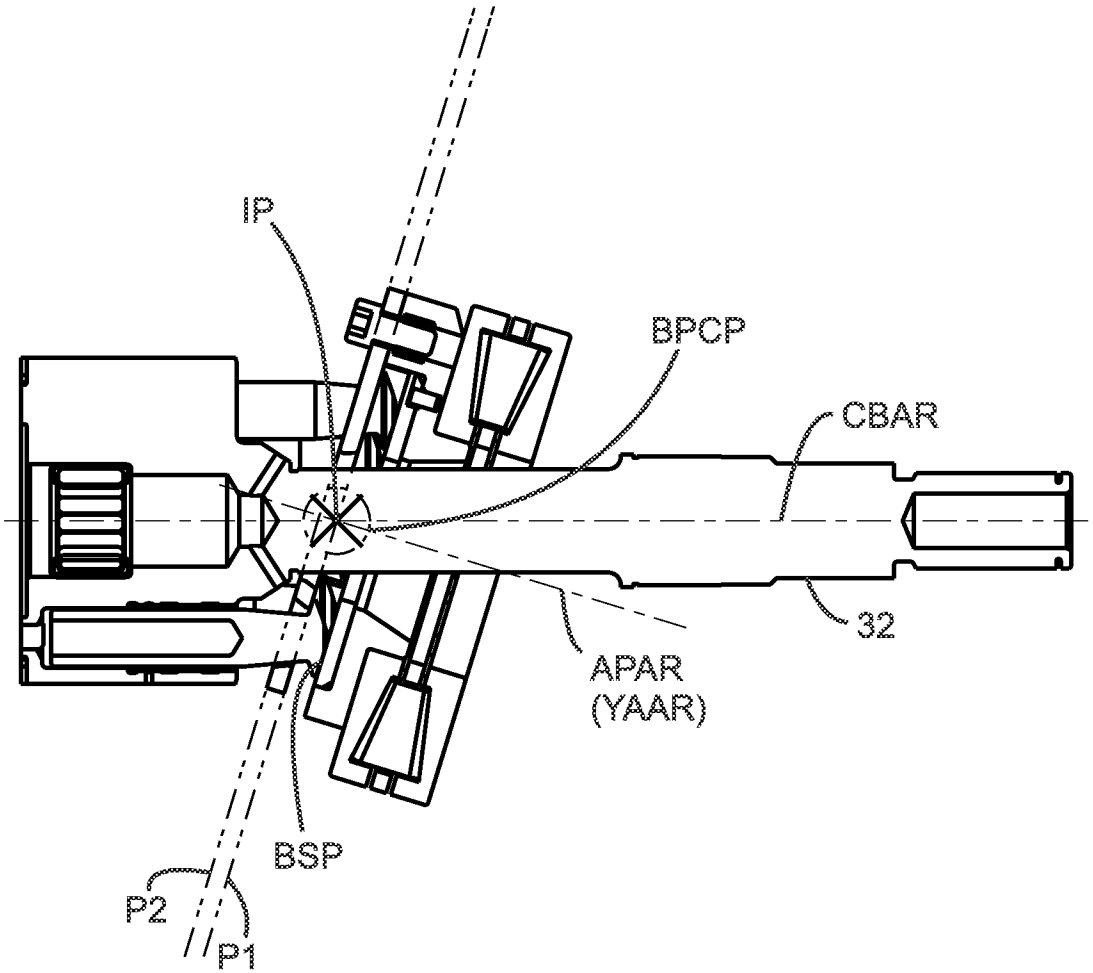
FIG. 9 is a cross-section of a portion of the pump of FIG. 1.
Figure 10:
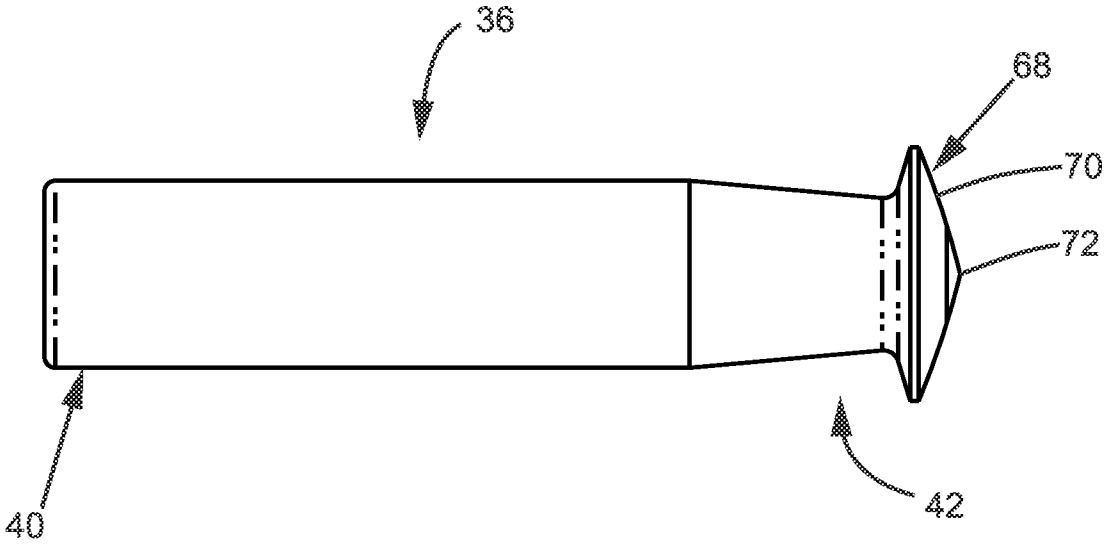
FIG. 10 is an isometric view of a piston of the pump of FIG. 1.
Figure 11:
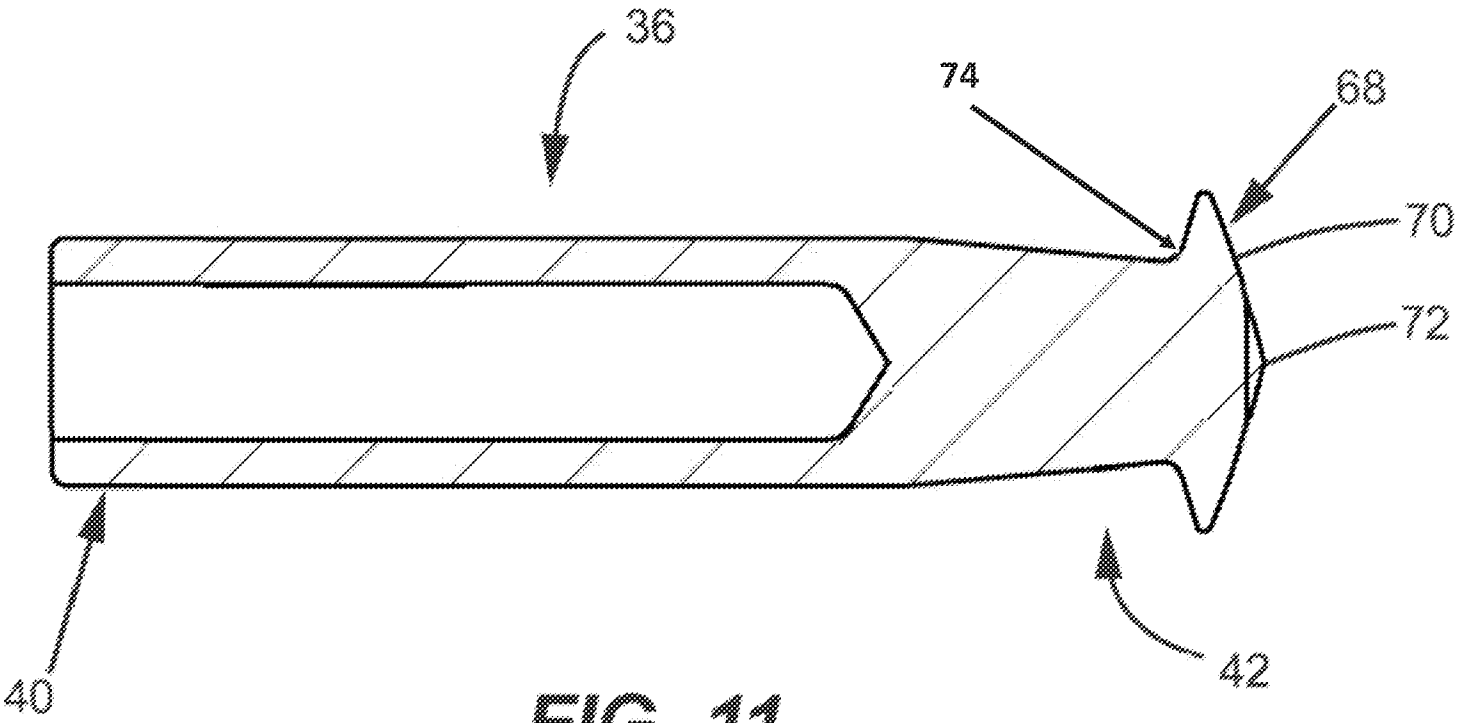
FIG. 11 is a cross-sectional view of the piston of FIG. 10.
Figure 12:
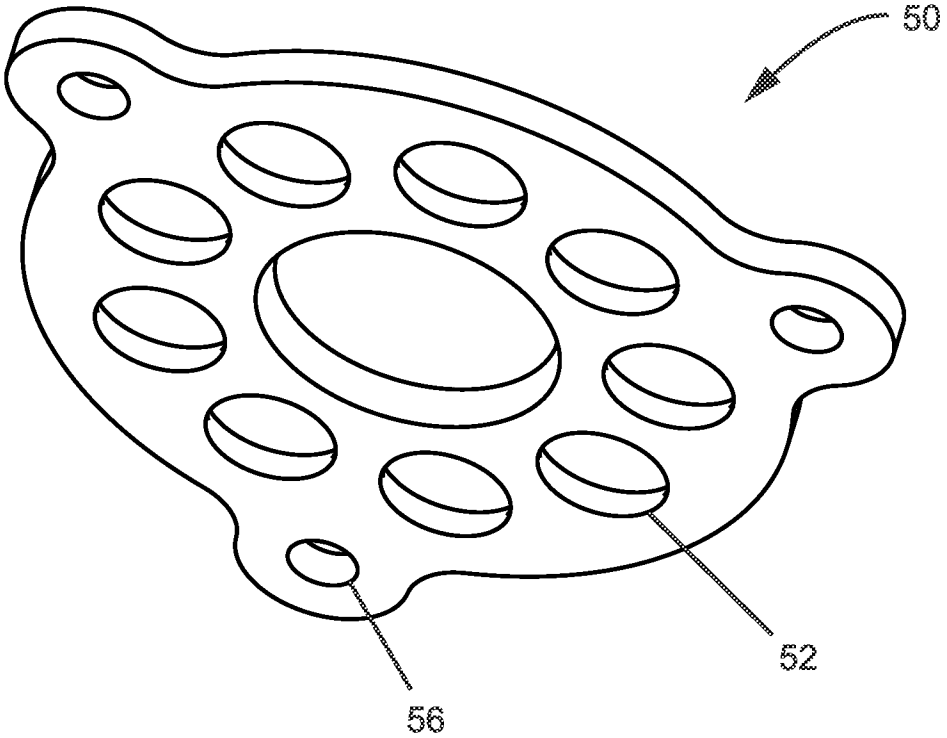
FIG. 12 is an isometric view of the dial plate of the pump of FIG. 1.
Figure 13:
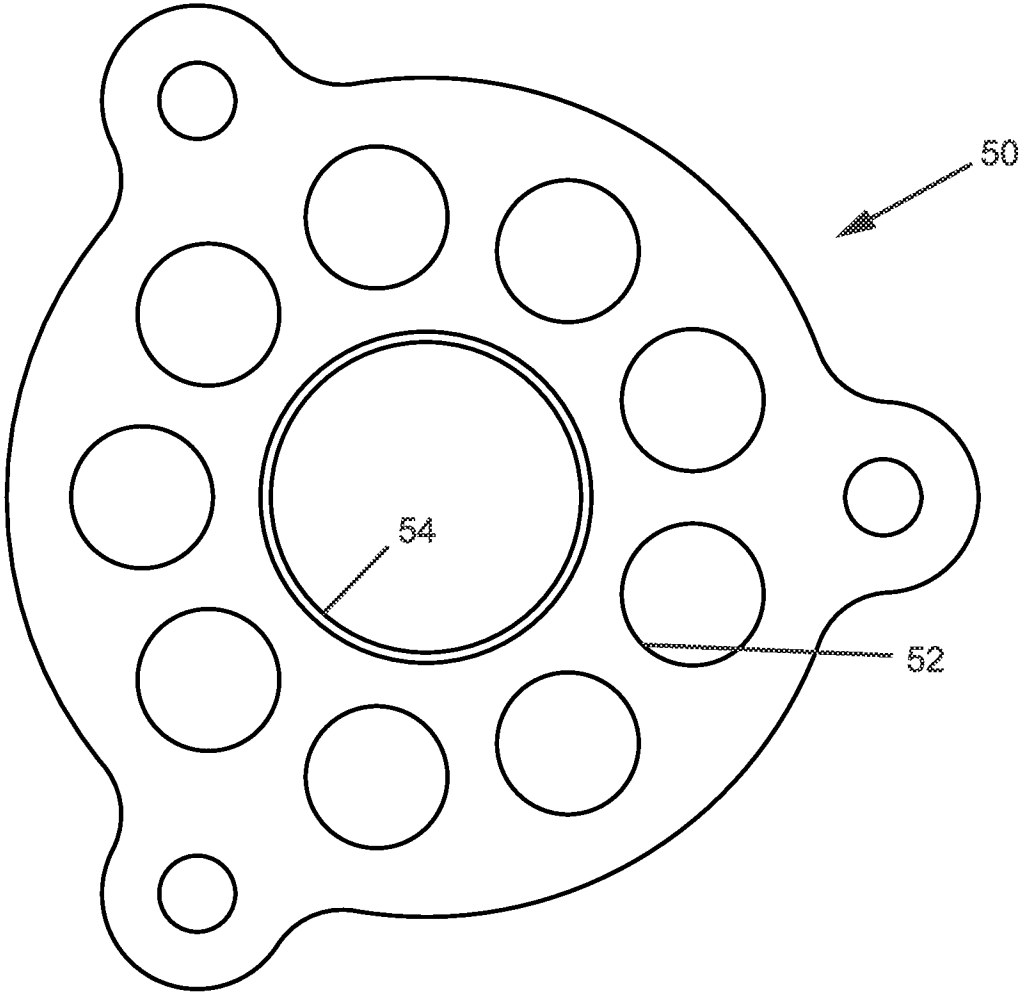
FIG. 13 is a top view of the dial plate of FIG. 12.
Figure 14:
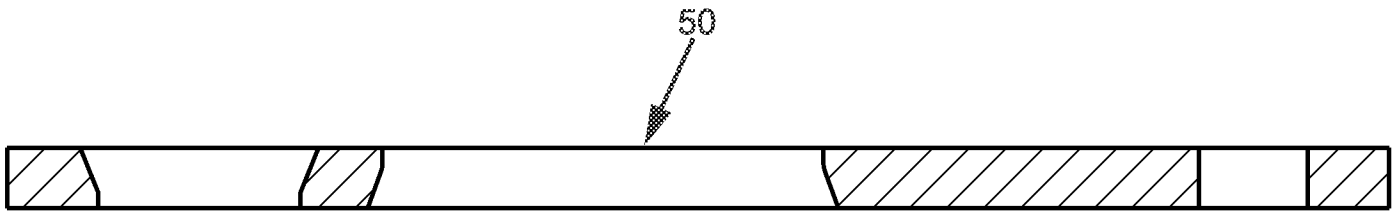
FIG. 14 is a cross-sectional view of the dial plate of FIG. 12.
Figure 15:
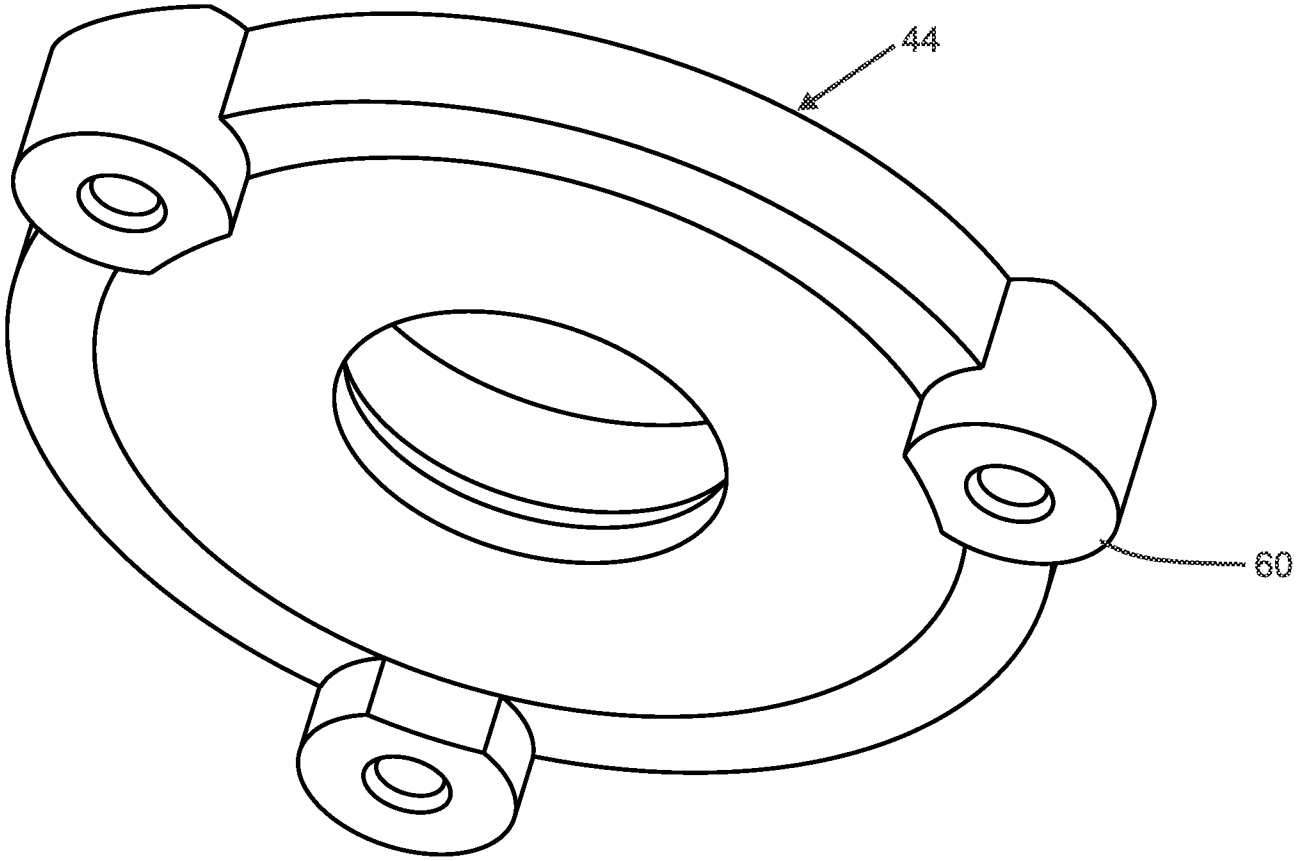
FIG. 15 is an isometric view of the bearing plate of the pump of FIG. 1.
Figure 16:
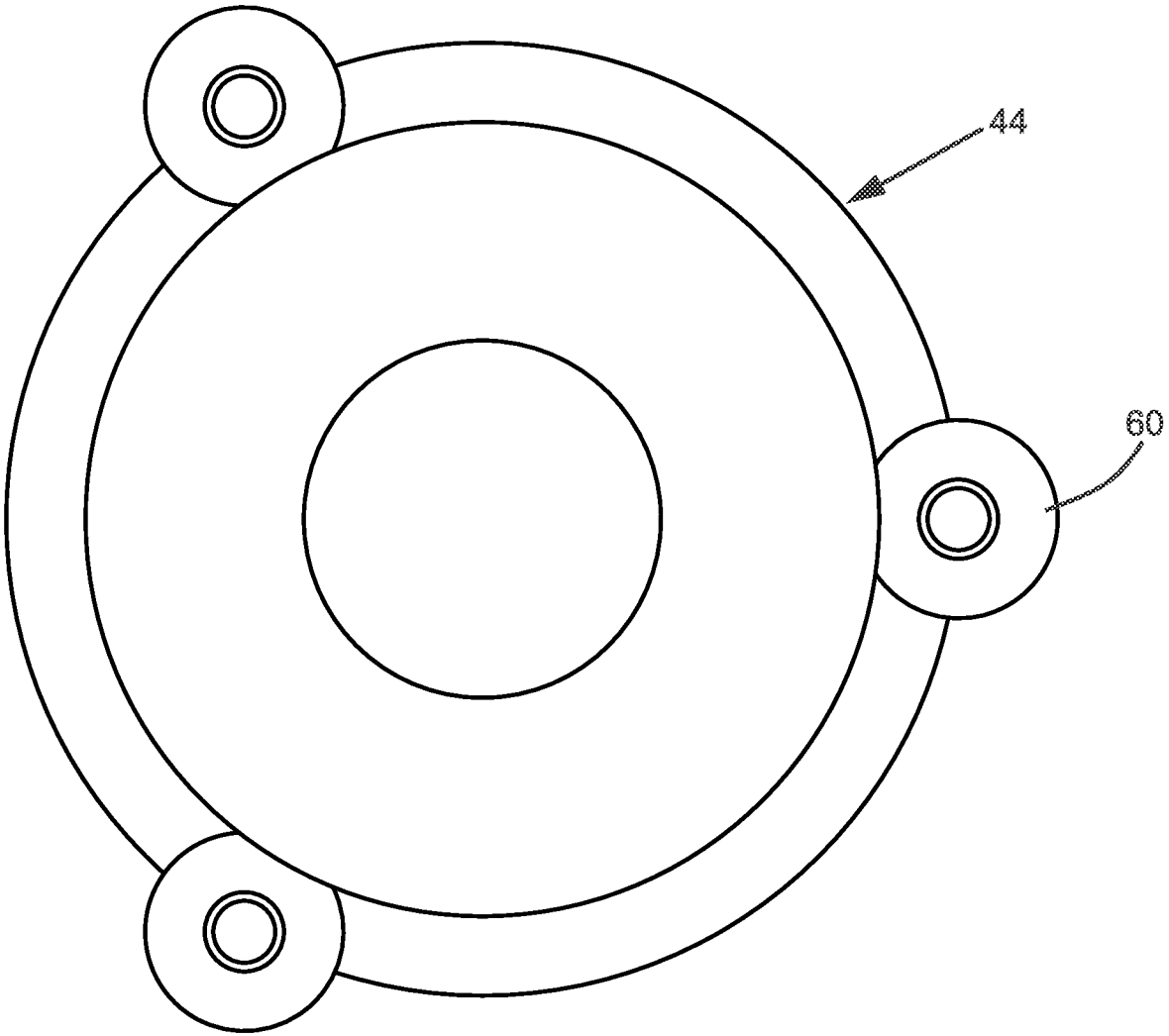
FIG. 16 is a top view of the bearing plate of FIG. 15 with the contact path with the pistons shown in dashed lines.
Figure 17:
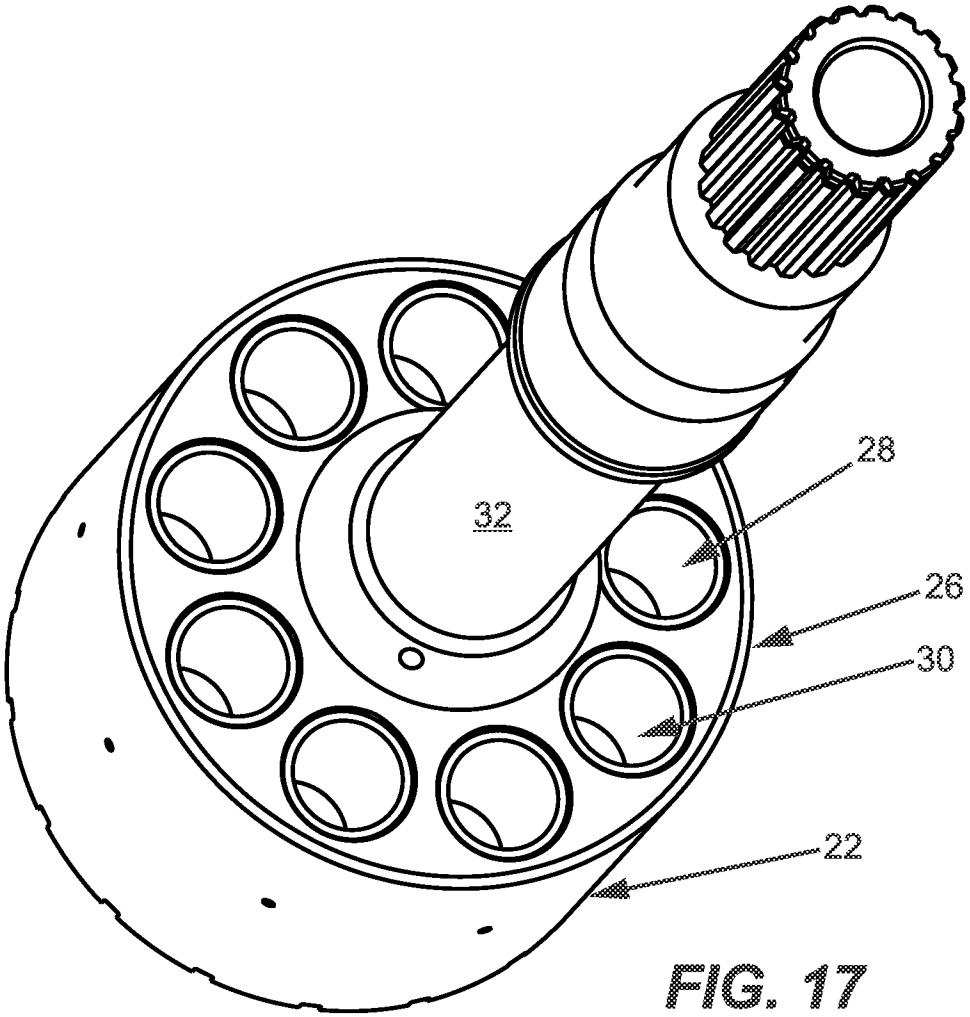
FIG. 17 is an isometric view of the cylinder block of the pump of FIG. 1.

In the depicted embodiment, the pump 10 includes a drive shaft 32 that includes a first end portion 34 that extends inside of the housing 12 and is configured to drive the rotation of the cylinder block 22 within the housing 12. The drive shaft 32 defines a cylinder block axis of rotation CBAR (see FIG. 9). In the depicted embodiment, the drive shaft 32 is integral with the cylinder block 22. It should be appreciated that many alternative drive shaft configurations are possible (e.g., the drive shaft can be separable from the cylinder block and splined to the cylinder block).

In the depicted embodiment, the pump 10 includes a plurality of pistons 36, 38. Each piston 36, 38 includes a first end portion 40 and a second end portion 42. Each piston 36, 38 is positioned within a cylindrical bore 28, 30 such that the piston 36, 38 can reciprocate within the cylindrical bore 28, 30 axially along the longitudinal axis of the piston 36, 38. The first end portions 40 of the pistons 36, 38 are positioned in the first end portion 24 of the cylinder block 22. The second end portions 42 of the pistons 36, 38 extend out of the second end portion 26 of the cylinder block 22. It should be appreciated that many alternative piston configurations are possible.

In the depicted embodiment, the second end portion 42 of the pistons 36, 38 includes a conical head portion that includes a conical distal end 68 with an annular wall 70 that forms a central point 72. In the depicted embodiment, the annular wall 70 is curved (e.g., elliptical cone, parabolic cone, etc.). In the depicted embodiment, if the second end portion 42 is tilted with respect to the bearing plate 48 such that the annular wall 70 contacts the bearing plate 48, only a small area of the annular wall 70 is in direct contact with the bearing plate 48 since the annular wall 70 is not straight. In the depicted embodiment, the back edge portion 74 of the cone forms an annular collar that has a larger diameter than the diameter of the other portions of the pistons 36, 38. In the depicted embodiment, the annular collar is a retaining collar that interfaces with a retainer 50 to limit axial movement of the pistons 36, 38. The retainer 50 will be described in further detail below. It should be appreciated that many alternative configurations of the pistons' second end portions are possible.

In the depicted embodiment, the pump 10 includes an angled yoke assembly located in the second end portion 16 of the housing 12. In the depicted embodiment, the yoke assembly is inclined relative to a plane that is perpendicular to the cylinder block axis of rotation CBAR. In the depicted embodiment, the yoke assembly includes a bearing surface BS configured to contact the second end portions 42 of the plurality of pistons 36, 38. In the depicted embodiment, the bearing surface BS of the yoke assembly is configured to rotate about a yoke assembly axis of rotation YAAR (coincident with the angled plate axis of rotation APAR) synchronously with the cylinder block 22. It should be appreciated that many alternative configurations of the angled yoke assembly are possible.

In the depicted embodiment, the yoke assembly axis includes an angled plate 44 that rotates on a bearing assembly 46. In the depicted embodiment, the yoke assembly also includes a bearing plate 48 that interfaces with the angled plate 44. These components of the yoke assembly of the present disclosure are described in further detail below. It should be appreciated that the angled yoke assembly in alternative embodiments may include more, less, and/or different components than are depicted herein.

In the depicted embodiment, the pump 10 includes an angled plate 44 located in the second end portion 16 of the housing 12. The angled plate 44 is inclined relative to a plane that is perpendicular to the cylinder block axis of rotation CBAR. In the depicted embodiment, the angle is fixed and set by the annular shim 64. In the depicted embodiment, the rotational speed of the drive shaft 32 varies in order to vary the flow of the pump 10 as desired. In the depicted embodiment, the rotational speed of the drive shaft 32 can vary from zero to over ten thousand rotations per minute. In addition, the direction of rotation can also vary. It should be appreciated that many alternative embodiments of the angled plate are possible. For example, in an alternative embodiment, the angle of the angled plate 44 could be adjustable.

In the depicted embodiment, the pump 10 includes a bearing assembly 46 provided between the angled plate 44 and the second end portion 16 of the housing 12. The bearing assembly 46 enables the angled plate 44 to rotate about an angled plate axis of rotation APAR (See FIG. 9). In the depicted embodiment, an intersection point IP that is defined as the intersection of the projection of the cylinder block axis of rotation CBAR and the projection of the angled plate axis of rotation APAR is within the plane P1 defined by a top surface of the retainer 50 and the plane P2 bottom surface of the retainer 50. It should be appreciated that many alternative configurations of the bearing assembly are possible.

In the depicted embodiment, the angled plate axis of rotation APAR intersects with a bearing surface plane BSP that is coincident with an exposed face of the bearing plate 48 at a bearing plate central point BPCP that is offset from the intersection point IP between the angled plate axis of rotation APAR and the cylinder block axis of rotation CBAR. In the depicted embodiment, the offset between the bearing plate central point BPCP and the intersection point IP between the angled plate axis of rotation APAR and the cylinder block axis of rotation CBAR is in the direction of the second end portion 16 of the housing 12 and along the angled plate axis of rotation APAR. In the depicted embodiment, the bearing plate central point BPCP is offset from the cylinder block axis of rotation CBAR. In the orientation shown in FIG. 9, the bearing plate central point BPCP is offset in a direction below the cylinder block axis of rotation CBAR. It should be appreciated that many alternative configurations are possible.

Figure 3:
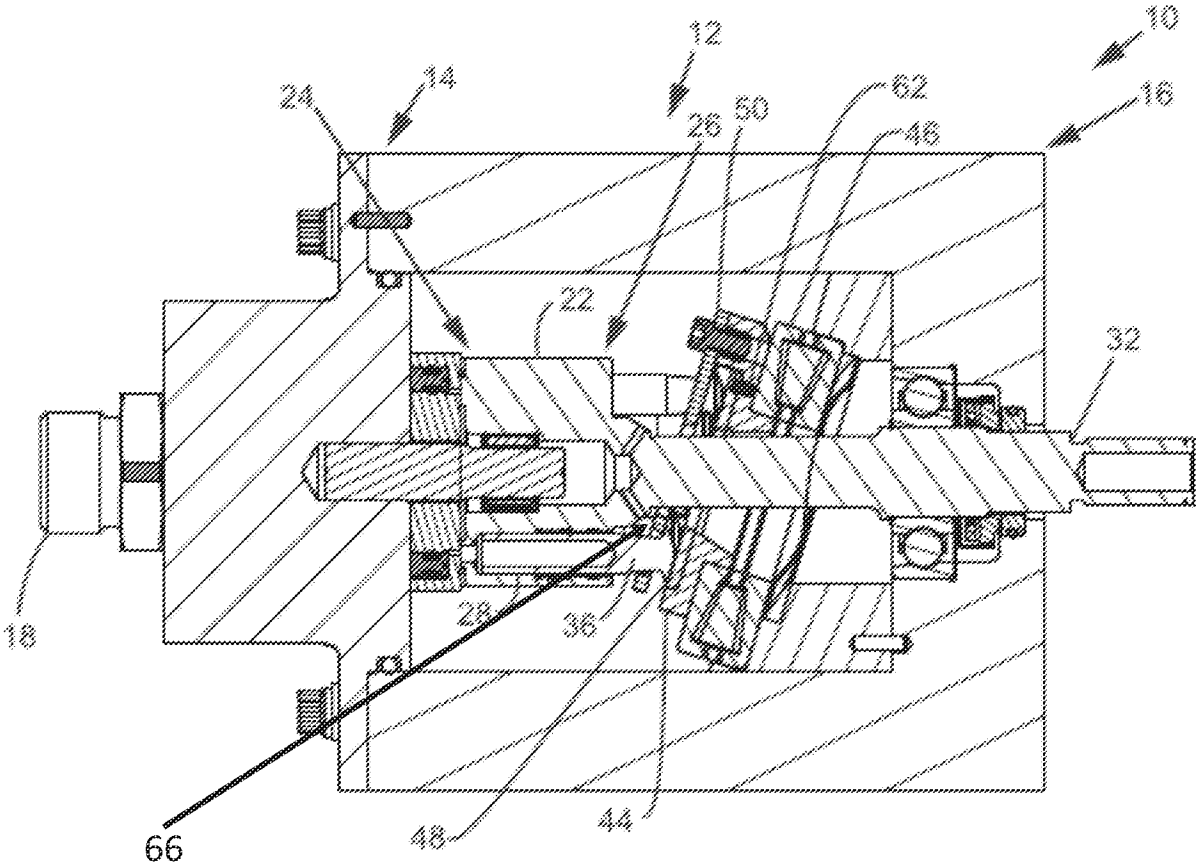
FIG. 3 is a cross-sectional view of the pump of FIG. 1 in a first position.
Figure 4:
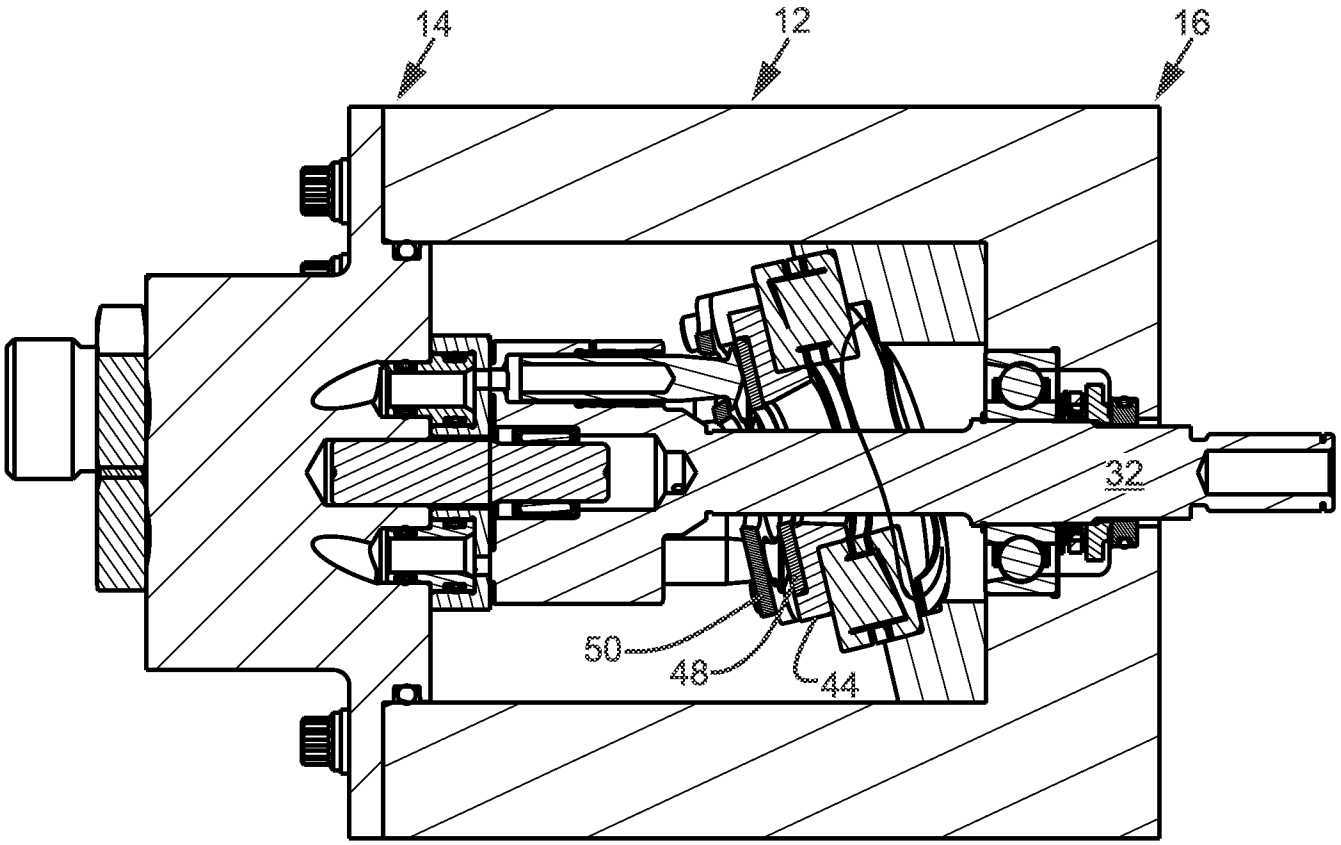
FIG. 4 is a cross-sectional view of the pump of FIG. 1 in a second position.
Figure 5:
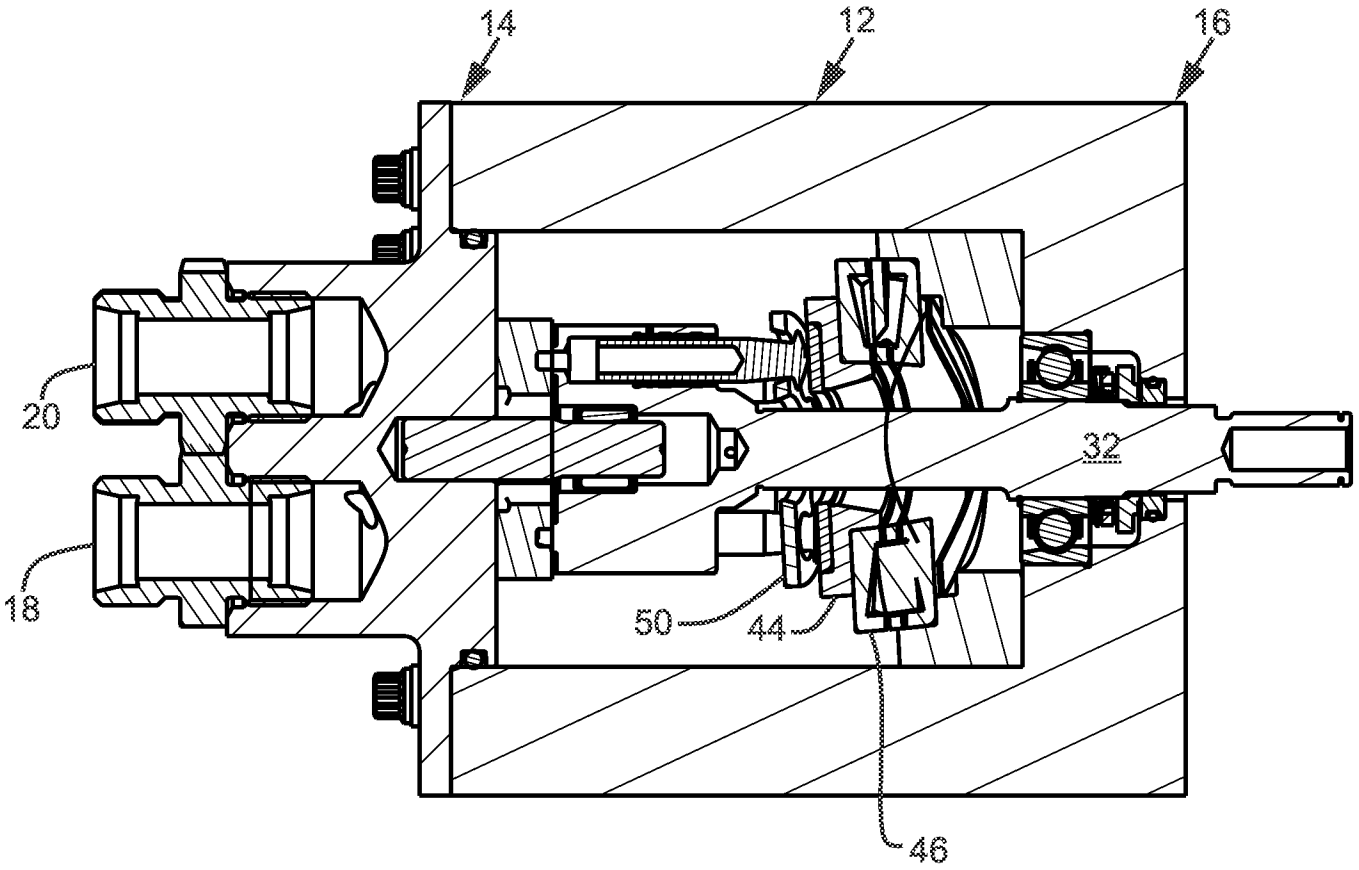
FIG. 5 is a cross-sectional view of the pump of FIG. 1 in a third position.
Figure 6:
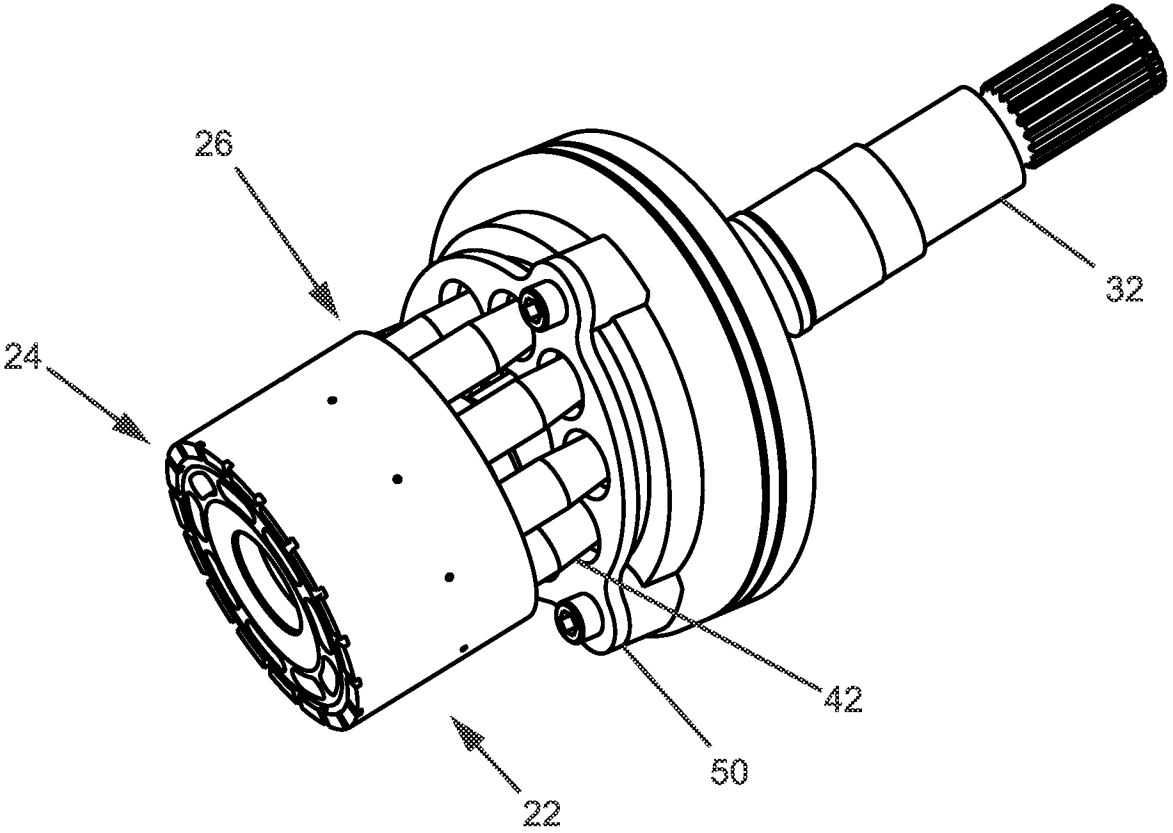
FIG. 6 is an isometric view of the pistons, yoke assembly, and cylinder (similar to what is shown below)
Figure 7:
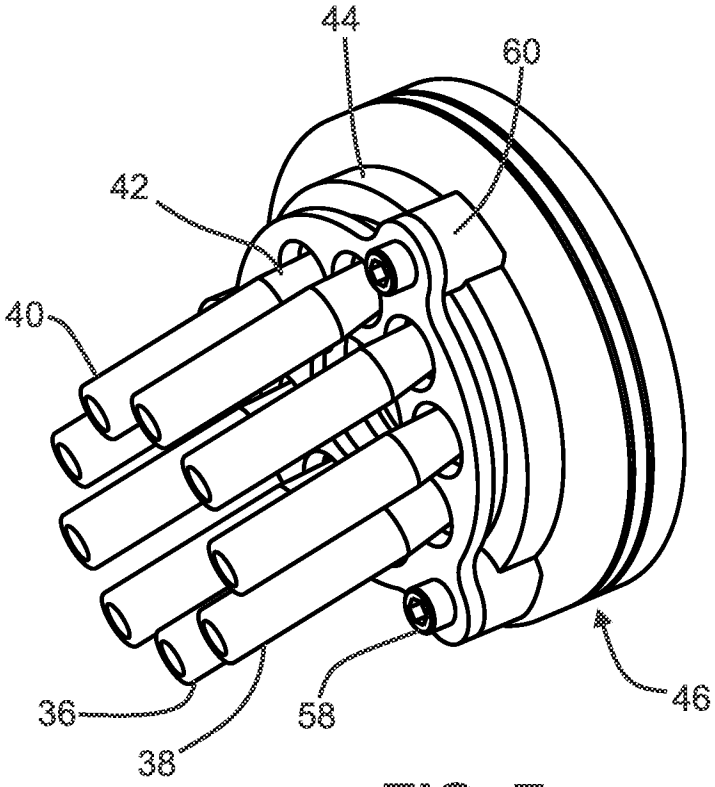
FIG. 7 is an isometric view of the piston and yoke assembly.
Figure 8:
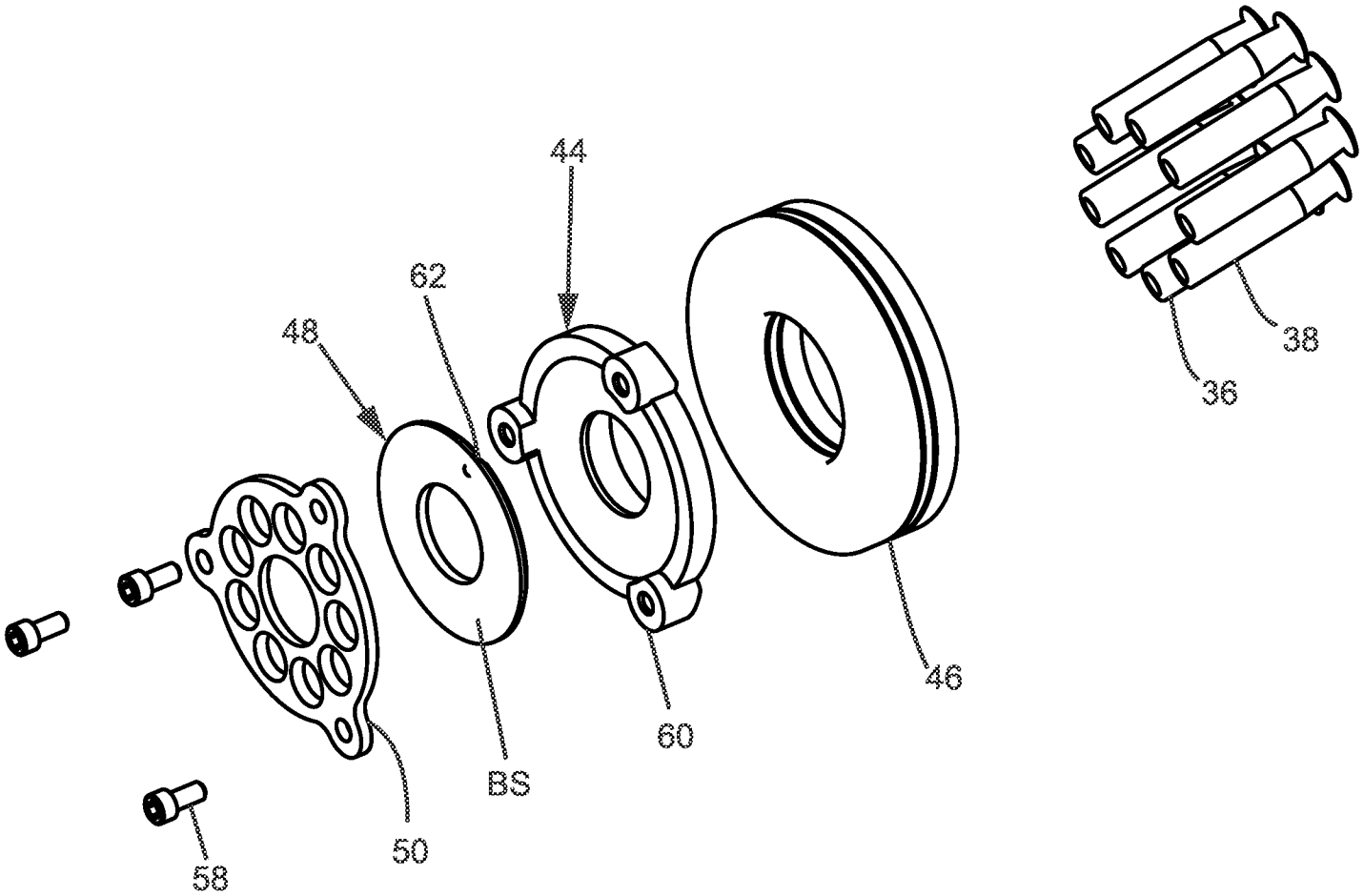
FIG. 8 is an exploded assembly view of the yoke assembly.

In the depicted embodiment, the pump 10 includes a bearing plate 48 that is secured to the angled plate 44. The bearing plate 48 is configured to contact with the second end portion 42 of the plurality of pistons 36, 38. In the depicted embodiment, the bearing plate 48 has a washer shape, and is received (e.g., pressed into) into a recess on the angled plate 44 thereby constraining its movements. In one embodiment, a pin 62 is received in the angled plate 44 and engages a recess in the bearing plate 48 to further limit movement of the bearing plate 48 relative to the angled plate 44. In the depicted embodiment, the pin 62 can constrain relative rotation between the bearing plate 48 and the angled plate 44 (see FIG. 3). It should be appreciated that many alternative configurations of the bearing plate are possible. For example, in an alternative embodiment, the bearing plate 48 is an integral surface of the angled plate 44 rather than a separable component part.

In the depicted embodiment, the pump 10 includes a retainer 50 configured to engage the second end portions 42 of the pistons 36, 38 and limit the axial motion of the pistons 36, 38. In the depicted embodiment, the angled plate 44, the bearing plate 48, and the retainer 50 are configured to rotate with the cylinder block 22. In the depicted embodiment, the retainer 50 is a plate that includes a plurality of outer apertures 52 arranged in circle around a central aperture 54. The second end portions 42 of the pistons 36, 38 extend through the outer apertures 52 and the drive shaft 32 extends through the central aperture 54. In the depicted embodiment, the retainer 50 is bolted to the angled plate 44. In the depicted embodiment, the retainer 50 includes three periphery apertures 56 that are equally spaced apart that receive bolts 58 that secure the retainer 50 onto raised mounting locations 60 of the angled plate 44. In the depicted embodiment, the raised mounting locations 60 are sized such that the retainer 50 when secured to the angled plate 44 constrains the pistons 36, 38 axially yet allows for relative movement of the pistons 36, 38 and the bearing plate 48. In operation, the second end portion 42 of the pistons 36, 38 are driven into contact with the bearing plate 48 during the compression/discharge stroke. The retainer 50 limits the amount the second end portions 42 of the pistons 36, 38 can axially separate from the bearing plate 48 during the suction/intake stroke. The limited axial movement provided by the retainer 50 minimizes the impact forces that the second end portions 42 of the pistons 36, 38 impart on the bearing plate 48. In the depicted embodiment, the longitudinal central axis of the pistons 36, 38 translates radially relative to the bearing plate 48 as the cylinder block 22 rotates about its axis. In the depicted embodiment, the point of contact between the second end portions 42 of the pistons 36, 38 and the bearing plate 48 during a full rotation of the cylinder traces an elliptical circle 66 on the bearing plate 48. In the depicted embodiment, the retainer plate limits the relative axial motion between the pistons 36, 38 and the bearing plate 48. It should be appreciated that many alternative embodiments of the retainer are possible.

In the depicted embodiment, the second end portions 42 of the pistons 36, 38 do not radially displace about the cylinder block axis of rotation CBAR relative to a stationary bearing plate 48. The bearing plate 48 rotates with the cylinder block 22 thereby minimizing relative displacement between the second end portions 42 of the pistons 36, 38. The cylinder block 22 and the bearing plate 48 rotate synchronously. The configuration also minimizes friction between the pistons 36, 38 and the bearing plate 48. This configuration prolongs the working lifespan of the pump 10. Additionally, minimizing friction increases the efficiency of the pump 10. In the depicted embodiment, the second end portion 42 of the pistons 36, 38 is constructed of hardened tool steel and the bearing plate 48 is also constructed of hardened tool steel. It should be appreciated that many alternative constructions are also possible.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. An axial piston device comprising:

a housing including a first end portion and a second end portion and including a low-pressure fluid inlet and a high-pressure fluid outlet at the first end portion of the housing;

a cylinder block rotatably positioned within the housing including a first end portion and a second end portion, the first end portion of the cylinder block being in the first end portion of the housing and the second end portion of the cylinder block being in the second end portion of the housing, the cylinder block including a plurality of cylindrical bores that extend from the first end portion to the second end portion of the cylinder block;

a drive shaft including a first end portion that extends inside of the housing and is configured to drive a rotation of the cylinder block within the housing, the drive shaft defining a cylinder block axis of rotation;

a plurality of pistons, each piston including a first end portion and a second end portion, the pistons being positioned within the cylindrical bores such that the pistons can reciprocate within the cylindrical bores axially along longitudinal axes of the pistons, the first end portions of the pistons being positioned in the cylinder block, and the second end portions of the pistons extending out of the second end portion of the cylinder block;

a yoke assembly located in the second end portion of the housing, the yoke assembly including an angled plate supported by a bearing assembly for rotation relative to the housing about a yoke assembly axis that is oriented at an oblique angle relative to the cylinder block axis of rotation, the angled plate defining a recess, the yoke assembly including a bearing plate that mounts in the recess and includes a bearing surface inclined relative to a plane that is perpendicular to the cylinder block axis of rotation, the bearing surface configured to contact the second end portions of the plurality of pistons, the angled plate and the bearing plate being configured to rotate about the yoke assembly axis synchronously with rotation of the cylinder block about the cylinder block axis of rotation;

a retainer configured to engage the second end portions of the plurality of pistons and limit an axial motion of the pistons relative to the bearing surface, wherein the retainer is a plate that mounts to the angled plate and that includes apertures, wherein each of the pistons extends through a corresponding one of the apertures;

the angled plate including raised mounting locations that are raised relative to the bearing surface such that a spacing is defined between the retainer and the bearing surface when the retainer is mounted to the raised mounting locations of the angled plate, the raised mounting locations defining retainer fastening locations spaced about an exterior of the bearing surface; and bolts for attaching the retainer to the raised mounting locations of the angled plate at the retainer fastening locations.

2. The axial piston device of claim 1, wherein the yoke assembly axis intersects with a bearing surface plane that is coincident with the bearing surface at a bearing plate central point, wherein the bearing plate central point is offset from an intersection point between the yoke assembly axis and the cylinder block axis of rotation, wherein the offset is in a direction of the second end portion of the housing along the yoke assembly axis, and wherein the bearing plate central point is offset from the cylinder block axis of rotation.

3. The axial piston device of claim 1, wherein the bolts are outwardly offset with respect to the pistons and positioned to not contact the pistons.

4. The axial piston device of claim 1, wherein the second end portion of each piston includes a conical head portion that defines an annular retaining collar.

5. The axial piston device of claim 1, wherein the axial piston device is a hydraulic pump.

6. An axial piston device comprising:

a housing including a first end portion and a second end portion and including a low-pressure fluid inlet and a high-pressure fluid outlet at the first end portion of the housing;

a cylinder block rotatably positioned within the housing including a first end portion and a second end portion, the first end portion of the cylinder block being in the first end portion of the housing and the second end portion of the cylinder block being in the second end portion of the housing, the cylinder block including a plurality of cylindrical bores that extend from the first end portion to the second end portion of the cylinder block;

a drive shaft including a first end portion that extends inside of the housing and is configured to drive a rotation of the cylinder block within the housing, the drive shaft defining a cylinder block axis of rotation;

a plurality of pistons, each piston including a first end portion and a second end portion, the pistons being positioned within the cylindrical bores such that the pistons can reciprocate within the cylindrical bores axially along longitudinal axes of the pistons, the first end portions of the pistons being positioned in the cylinder block, and the second end portions of the pistons extending out of the second end portion of the cylinder block;

an angled plate located in the second end portion of the housing, the angled plate defining a recess;

a bearing assembly provided between the angled plate and the second end portion of the housing enabling the angled plate to rotate about an angled plate axis of rotation that is oriented at an oblique angle with respect to the cylinder block axis of rotation;

a bearing plate positioned within the recess of the angled plate, the bearing plate including a bearing surface configured to contact with the second end portions of the plurality of pistons, the angled plate being configured to support the bearing plate such that the bearing surface is oriented at an oblique angle with respect to the cylinder block axis of rotation;

a retainer that mounts to the angled plate, the retainer being configured to engage the second end portions of the plurality of pistons and limit an axial motion of the pistons relative to the bearing plate, wherein the retainer defines a plurality of apertures, and wherein each of the pistons extends through a corresponding one of the apertures;

bolts for attaching the retainer to the angled plate, the bolts having lengths that extend along the angled plate axis of rotation, the bolts being positioned to not contact the pistons; and wherein the angled plate, the bearing plate, and the retainer are configured to rotate about the angled plate axis of rotation synchronously with rotation of the cylinder block about the cylinder block axis of rotation.

7. The axial piston device of claim 6, wherein the bolts clamp the retainer axially against the angled plate.

8. The axial piston device of claim 6, further comprising a pin that limits relative rotation between the bearing plate and the angled plate.

9. The axial piston device of claim 6, wherein the second end portion of each piston includes a conical shape.

10. The axial piston device of claim 6, wherein the second end portion of each piston includes a head having a tapered shape, wherein an annular face of the tapered shape is adapted to contact the bearing surface and defines a convex curved profile along a longitudinal direction of the piston.

11. The axial piston device of claim 6, wherein the second end portion of each piston includes an annular collar that engages the retainer.

12. The axial piston device of claim 6, wherein the angle of the angled plate is fixed.

13. The axial piston device of claim 6, wherein a rotational speed of the drive shaft varies in order to vary a flow rate of the axial piston device.

14. The axial piston device of claim 6, wherein an intersection of a projection of the cylinder block axis of rotation and a projection of the angled plate axis of rotation is within planes defined by a top surface of the retainer and a bottom surface of the retainer.

15. The axial piston device of claim 6, wherein the angled plate axis of rotation intersects with a bearing surface plane coincident with an exposed face of the bearing plate at a bearing plate central point that is offset from an intersection point between the angled plate axis of rotation and the cylinder block axis of rotation, wherein the offset is in a direction of the second end portion of the housing along the angled plate axis of rotation.

16. The axial piston device of claim 6, wherein the angled plate axis of rotation intersects with a bearing surface plane coincident with an exposed face of the bearing plate at a bearing plate central point, wherein the bearing plate central point is offset from the cylinder block axis of rotation.

17. An axial piston device comprising:

a cylinder block rotatable about a cylinder block axis of rotation, the cylinder block including a plurality of cylinder block bores;

a plurality of pistons, each piston including a first end portion and a second end portion, the pistons being positioned within the cylinder block bores such that the pistons can reciprocate within the cylinder block bores axially along longitudinal axes of the pistons, the first end portions of the pistons being positioned in the cylinder block, and the second end portions of the pistons extending out of the cylinder block;

an angled plate configured to rotate about an angled plate axis of rotation that is oriented at an oblique angle with respect to the cylinder block axis of rotation;

a bearing surface that rotates with the angled plate about the angled plate axis of rotation, the bearing surface being configured to contact with the second end portions of the plurality of pistons, the bearing surface being oriented at an oblique angle with respect to the cylinder block axis of rotation;

a retainer that mounts to the angled plate, the retainer being configured to engage the second end portions of the plurality of pistons and limit an axial motion of the pistons relative to the bearing surface, wherein the retainer defines a plurality of apertures, and wherein each of the pistons extends through a corresponding one of the apertures;

bolts for attaching the retainer to the angled plate, the bolts having lengths that extend along the angled plate axis of rotation, the bolts being spaced from the pistons to prevent contact between the pistons and the bolts fasteners; and wherein the angled plate, the bearing surface, and the retainer are configured to rotate about the angled plate axis of rotation synchronously with rotation of the cylinder block about the cylinder block axis of rotation, and wherein the bearing surface is defined by a bearing plate that mounts to the angled plate.

18. The axial piston device of claim 17, wherein the bolts axially clamp the retainer with respect to the angled plate to establish an axial spacing between a portion of the retainer that defines the apertures and the bearing surface.

19. The axial piston device of claim 17, further comprising raised mounting locations of the angled plate that project in an axial orientation relative to the angled plate axis of rotation for setting an axial spacing between an aperture defining portion of the retainer and the bearing surface when the retainer is fastened to the angled plate, and wherein the retainer is axially clamped in place relative to the angled plate.

* * * * *